US006314252B1

(12) United States Patent
Matsumoto

(10) Patent No.: US 6,314,252 B1
(45) Date of Patent: Nov. 6, 2001

(54) IMAGE FORMING APPARATUS AND METHOD OF A FORMING IMAGE

(75) Inventor: Hirotaka Matsumoto, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/521,953

(22) Filed: Mar. 9, 2000

(51) Int. Cl.[7] ..... G03G 15/00; G03G 15/20
(52) U.S. Cl. ..... 399/45; 399/68; 399/69
(58) Field of Search ..... 399/44, 45, 67, 399/68, 69, 70, 328

(56) References Cited

U.S. PATENT DOCUMENTS

| | | | | |
|---|---|---|---|---|
| 5,561,512 | * | 10/1996 | Fukano et al. | 399/69 |
| 5,621,511 | * | 4/1997 | Nakayama | 399/44 |
| 5,848,319 | * | 12/1998 | Morigami et al. | 399/68 X |
| 5,862,436 | * | 1/1999 | Ishizawa et al. | 399/69 |
| 5,991,563 | * | 11/1999 | Haneda et al. | 399/68 |
| 6,151,462 | * | 11/2000 | Fukizawa et al. | 399/67 |

FOREIGN PATENT DOCUMENTS

| | | |
|---|---|---|
| 5-5112 | 1/1993 | (JP) . |
| 9-179437 | 7/1997 | (JP) . |

* cited by examiner

*Primary Examiner*—Sandra Brase
(74) *Attorney, Agent, or Firm*—Foley & Lardner

(57) ABSTRACT

A fixing unit for a copying machine has a heating roller having a heating portion therein, and a press roller provided in rolling contact with the heating roller. The heating roller has a paper passing region which comes into contact with a copy medium of any size, and a paper non-passing region which does not come into contact with a copy sheet of any size. A fixing control unit for the fixing unit controls the heating portion such that a temperature of the paper passing region of the heating roller becomes a predetermined temperature, and controls image forming operation of an image forming unit and convey operation of sheet convey mechanism in accordance with a size of a copy sheet to be fed next, and a temperature of the paper non-passing region. Upon continuous image forming operation on a plurality of small-size copy sheets, when the temperature of the paper non-passing region of the heating roller becomes higher than usual, if image formation is to be successively performed on a small-size copy sheet, the image forming operation of the image forming unit and the convey operation of the convey mechanism are continued. If image formation is to be performed on a larger-size copy sheet, the image forming operation of the image forming unit and the convey operation of the convey mechanism are set in the standby state until the temperature of the heating roller decreases to a predetermined temperature.

17 Claims, 11 Drawing Sheets

| SHEET WIDTH X | END TEMPERATURE CONDITION FOR SETTING COPYING OPERATION STANDBY MODE |
|---|---|
| x≦LT-R | 230℃ OR MORE |
| LT-R<x≦B4 | 220℃ OR MORE |
| B4<x | 210℃ OR MORE |
FIG. 9
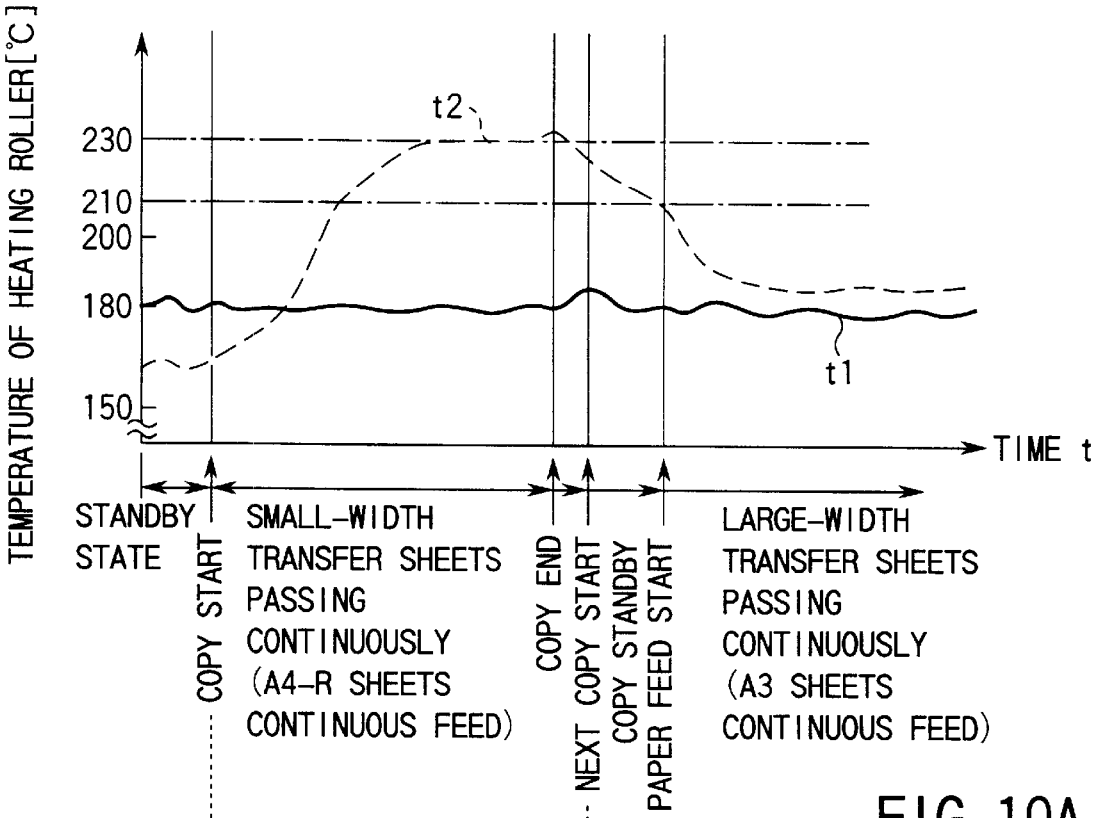
FIG. 10A
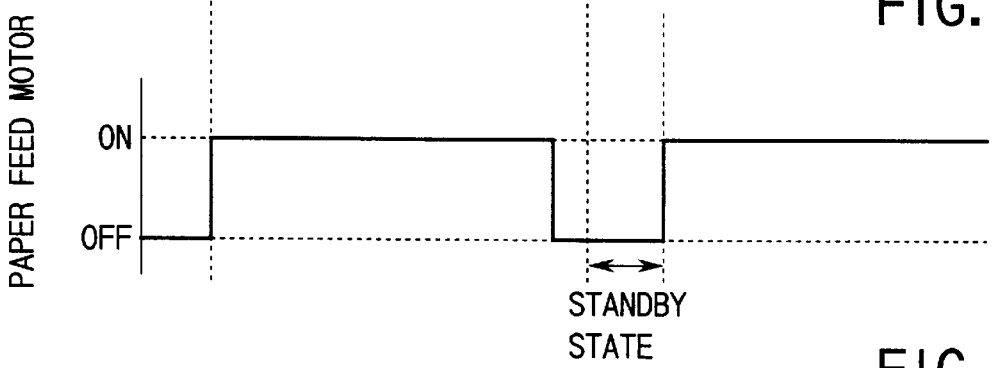
FIG. 10B

| END TEMPERATURE CONDITION FOR NEXT PRINT START | CONDITION FOR PRINT OPERATION (SHEET SIZE: X) |
|---|---|
| t2≧230℃ | PAPER FEED STANDBY STATE (WAIT STATE) |
| 220≦t2<230℃ | SELECT IMAGE SOURCE FOR WIDTH SATISFYING X≦LT-R |
| 210≦t2<220℃ | SELECT IMAGE SOURCE FOR WIDTH SATISFYING X≦B4 |
| t2<210 | PERFORM NORMAL CONTROL REGARDLESS OF SHEET SIZE |

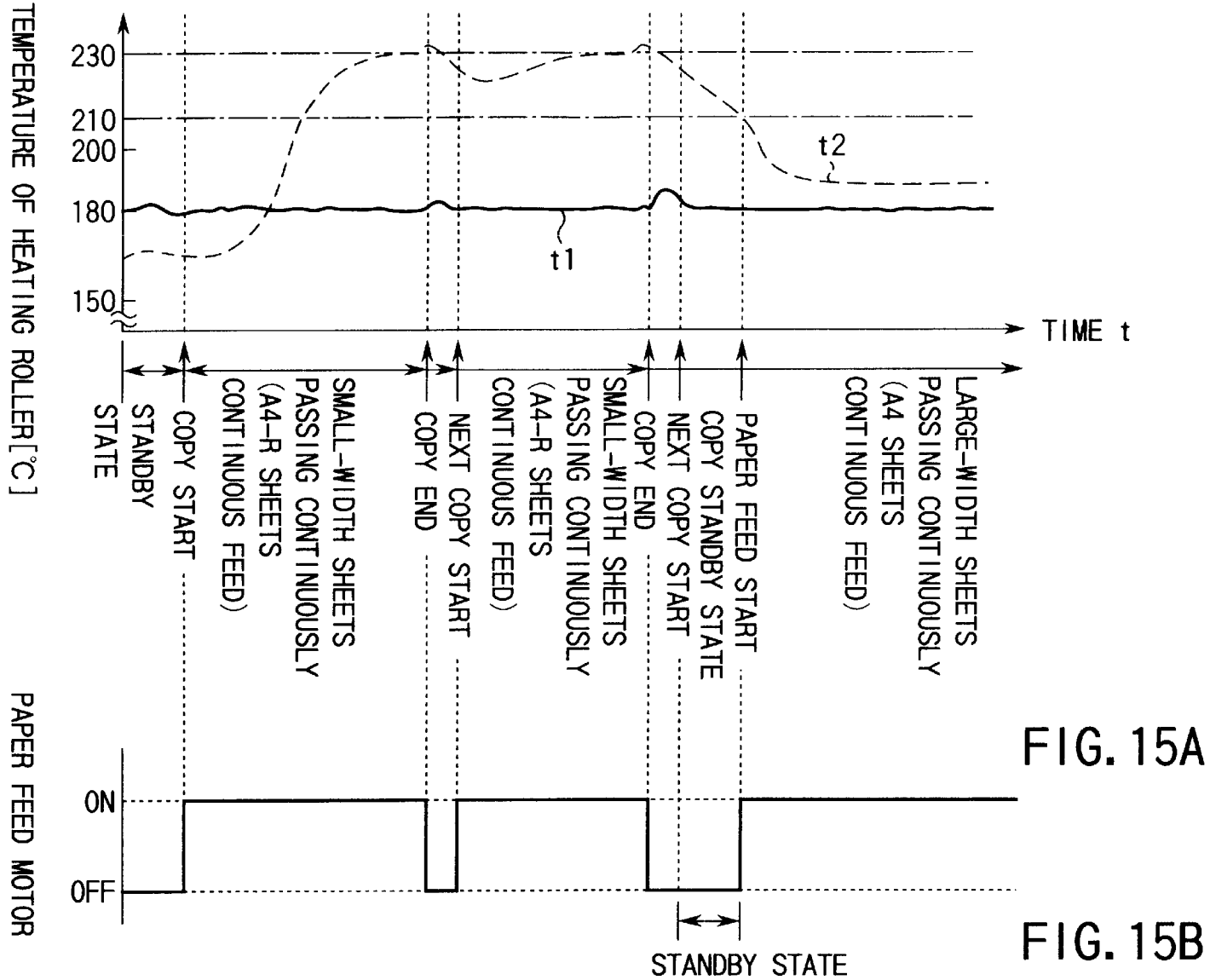
FIG. 15A
FIG. 15B
TIME t
LARGE-WIDTH SHEETS PASSING CONTINUOUSLY (A4 SHEETS CONTINUOUS FEED)
PAPER FEED START
COPY STANDBY STATE
NEXT COPY START
COPY END
SMALL-WIDTH SHEETS PASSING CONTINUOUSLY (A4-R SHEETS CONTINUOUS FEED)
NEXT COPY START
COPY END
SMALL-WIDTH SHEETS PASSING CONTINUOUSLY (A4-R SHEETS CONTINUOUS FEED)
COPY START
STANDBY STATE
STANDBY STATE
t1
t2
230
210
200
180
150
TEMPERATURE OF HEATING ROLLER[℃]
ON
OFF
PAPER FEED MOTOR

IMAGE FORMING APPARATUS AND METHOD OF A FORMING IMAGE

BACKGROUND OF THE INVENTION

The present invention relates to an image forming apparatus for fixing a developer image formed on a transfer medium with a fixing unit, thereby forming an image, and to a method of forming an image.

An image forming apparatus such as a copying machine or a printer has a fixing unit for heating and fusing a developer image formed on a transfer sheet, thereby fixing the developer image on the transfer sheet. This fixing unit generally has a heating roller incorporating a heat source such as a heater, and a press roller in rolling contact with the heating roller with a predetermined pressure. The transfer sheet formed with the developer image is conveyed through a portion between the heating roller and press roller. During conveyance, the developer image is fixed to the transfer sheet by the heat and pressure respectively applied by the heating roller and press roller.

In the fixing unit having the above arrangement, in order to sufficiently fix the developer image on the transfer sheet, the heating roller and press roller must be maintained at a predetermined temperature. For this purpose, usually, the surface temperature of the heating roller is detected by a temperature sensor such as a thermistor, and the heat source is controlled in accordance with the detection result.

According to a device disclosed in Jpn. Pat. Appln. KOKAI Publication No. 9-179437, a reference temperature for a heating roller is set in advance in accordance with the size of a transfer sheet to be used, and the temperature of the heating roller is controlled on the basis of the reference temperature.

In a copying machine, various types of transfer sheets are prepared in accordance with the sizes of images to be formed, and transfer sheets having sizes corresponding to the images are selectively supplied. The widths, i.e., the axial lengths, of the heating roller and press roller of the fixing unit are set in accordance with the maximum-size transfer sheet to be used.

Therefore, in this fixing unit, when fixing is to be performed on a small-width sheet as a transfer sheet, a paper passing region where the transfer sheet passes and which comes into contact with the transfer sheet, and a paper non-passing region which does not come into contact with the transfer sheet, i.e., where the transfer sheet does not pass, are generated in a press contact portion between the heating roller and the press roller. When continuous copying operation is performed by using a plurality of these small-width sheets, the heat consumption amount differs between the paper passing region and the paper non-passing region, and the paper non-passing region is heated to a temperature higher than a predetermined temperature. In the subsequent copying operation, when a large-width transfer sheet is used, it partly passes the excessively heated paper non-passing region in the fixing unit. This leads to an image defect such as a high-temperature offset, or a paper passing defect such as a paper separation defect.

According to an apparatus disclosed in Jpn. Pat. Appln. KOKOKU Publication No. 5-5112, when continuous copying operation is performed on a predetermined number of transfer sheets or more, the predetermined temperature of a heating roller is gradually decreased during the continuous copying operation, so that an excessive temperature increase of a paper non-passing region is prevented.

In recent years, a composite image forming apparatus, in which a plurality of functions such as those of a copying machine, a printer, and a facsimile are combined, has been proposed as an image forming apparatus. In this image forming apparatus, various types of image data are input from an external device such as a personal computer or from a communication line. These image data are subjected to mixing and processed by an interrupt to form an image. Accordingly, in the composite image forming apparatus of this type, small-width transfer sheets and large-width transfer sheets are mixedly used more often than in an analog copying machine, and an image defect and a paper passing defect in the fixing unit described above tend to occur.

BRIEF SUMMARY OF THE INVENTION

The present invention has been made in view of the above situation, and has as its object to provide an image forming apparatus and a method of forming image in which occurrence of a fixing defect can be prevented and an image forming efficiency is improved.

In order to achieve the above object, according to the present invention, there is provided an image forming apparatus comprising: image forming means for forming a developer image on a recording sheet; fixing means for heating and pressing the developer image formed by the image forming means to fix the developer image on the recording sheet; a paper feed section for selectively feeding various types of recording media having different sizes; convey means for conveying the recording sheet fed from the paper feed section through the image forming unit and the fixing unit; a size detector for detecting a size of the recording sheet fed from the paper feed section; a temperature detector for detecting a surface temperature of the fixing means; and control means for controlling a fixing temperature of the fixing means in accordance with a predetermined reference temperature, and controlling image forming operation of the image forming means and recording sheet convey operation of the convey means in accordance with a size of a recording sheet to be fed next and the surface temperature of the fixing means which is detected by the temperature detector.

A method of forming image according to the present invention comprises the steps of: selectively supplying a recording medium with a size corresponding to an image to be formed; forming a developer image on the supplied recording medium; and heating and pressing the developer image formed on the recording medium by fixing means, thereby fixing the developer image on the recording medium;

the step of fixing the developer image including: detecting a surface temperature of the fixing means; and controlling a fixing temperature of the fixing means in accordance with a predetermined reference temperature, and controlling image forming operation of the developer image and recording medium supplying operation in accordance with a size of a recording medium to be supplied next and the detected surface temperature of the fixing means.

According to the image forming apparatus and the image forming method having the above arrangement, upon continuous image forming operation on a plurality of small-size copy media, when the temperature at the end of the heating roller becomes higher than usual, the image forming operation of the image forming means and the convey operation of the convey means are controlled in accordance with the size of a recording sheet to be fed next and the temperature of the fixing means. More specifically, when image formation is to be successively performed on a small-size recording sheet, the image forming operation of the image forming means and the convey operation of the convey means are continued. When image formation is to be performed on a larger-size recording sheet, the image forming operation of the image forming means and the convey operation of the convey means are set in the standby state until the temperature of the fixing means decreases to a predetermined temperature. As a result, a fixing defect can be prevented, and a standby time for the image forming operation can be shortened, thereby improving the efficiency.

According to the present invention, there is also provided an image forming apparatus comprising: a storage portion for storing various types of input image data; image forming means for forming a developer image on a recording sheet in accordance with the image data sent from the storage portion; fixing means for heating and pressing the recording sheet where the developer image has been formed by the image forming means, thereby fixing the developer image on the recording sheet; a paper feed section containing various types of recording media having different sizes, for selectively supplying a recording sheet having a size corresponding to a size of image data sent from the storage portion; convey means for conveying the recording sheet fed from the paper feed section through the image forming means and the fixing means; a temperature detector for detecting a surface temperature of the fixing means; and control means for controlling the heating portion in accordance with a predetermined reference temperature, and selecting image data to be subjected to image formation next from the storage unit in accordance with the surface temperature of the heating roller which is detected by the temperature detecting unit.

According to the image forming apparatus having the above arrangement, image data corresponding to a recording sheet with a size appropriate for the surface temperature of the fixing means, which is detected by the temperature detector, is selected from the storage portion, and image forming operation of this image data is started preferentially. Therefore, for example, upon continuous image formation on a plurality of small-size copy media, when the temperature at the end of the fixing means becomes higher than a normal temperature, if image data corresponding to a similarly small-size recording sheet is present, this image data is selected, and image forming operation is continued. If image data corresponding to a recording sheet with a size appropriate for the temperature of the fixing means is not present, the image forming operation of the image forming means and the convey operation of the convey means are set in the standby state until the temperature of the fixing means decreases to a predetermined temperature. As a result, a fixing defect can be prevented, and a standby time for the image forming operation can be shortened, thereby improving the efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

FIGS. 1 to 15 show a digital copying machine according to an embodiment of the present invention, in which FIG. 1 is a sectional view of the digital copying machine;

FIG. 2 is a block diagram showing the control system of the digital copying machine;

FIG. 3 is a sectional view showing the fixing unit of the digital copying machine;

FIG. 4 is a front view showing the heating roller and press roller of the fixing unit;

FIG. 5 is a block diagram schematically showing the arrangement of the fixing unit;

FIG. 6 is a graph showing a temperature change in the heating roller that takes place when continuous copying operation is performed on a plurality of copy sheets;

FIG. 7 is a graph showing the temperature distribution of the heating roller which is obtained when continuous copying operation is performed on a plurality of copy sheets;

FIG. 8 is a flow chart showing the copying operation in the digital copying machine;

FIG. 9 is a table showing a control condition for the copying operation;

FIG. 10A is a graph showing an example of a temperature change in the heating roller in the copying operation;

FIG. 10B is a timing chart showing the ON/OFF states of a paper feed motor during the copying operation;

FIG. 12 is a timing chart showing the copying operation and operations of printing image data and facsimile image data input from external devices in the digital copying machine;

FIG. 13 is a table showing a control condition for the print operation;

FIG. 14 is a flow chart showing an example of the print operation;

FIG. 15A is a graph showing an example of the temperature change in the heating roller in the print operation; and FIG. 15B is a timing chart showing the ON/OFF states of the paper feed motor during the print operation.

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment in which an image forming apparatus according to the present invention is applied to a digital copying machine will be described in detail with reference to the accompanying drawing.

This digital copying machine is a multi-functional copying machine for forming a copy image in accordance with image data read from an original, image data input from an external device such as a personal computer, and image data sent through a public line, i.e., in accordance with image data from a facsimile.

Figure 1:
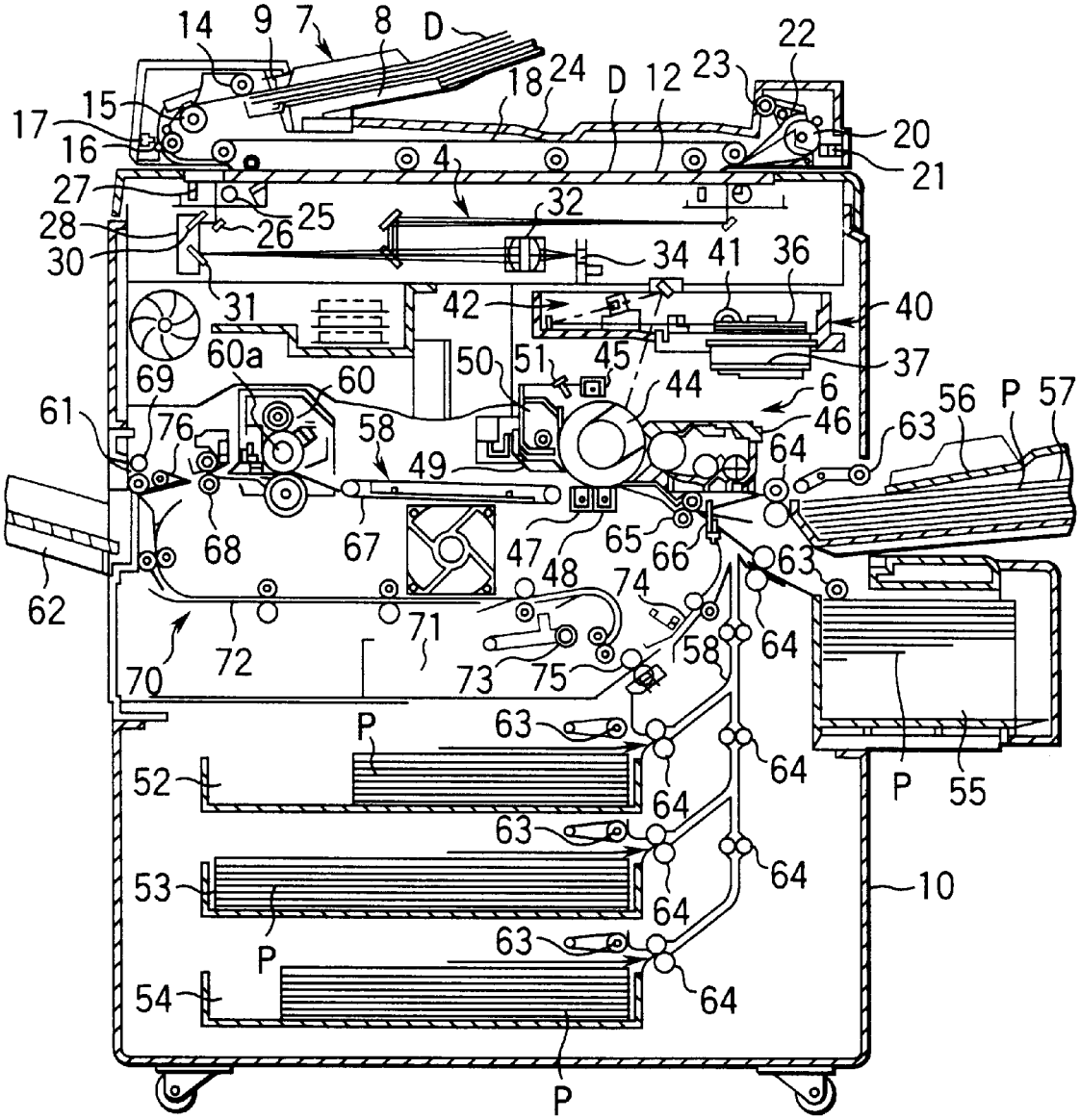

As shown in FIG. 1, the digital copying machine has a rectangular box-shaped housing 10. A scanner unit 4 which serves as an image reader, and a printer unit 6 for forming an image on a copy sheet are provided in the housing 10.

An original table 12 made of transparent glass, on which an original D having a reading target, i.e., a processing target image, is to be set is formed on the upper surface of the housing 10. An automatic document feeder 7 (to be referred to as the ADF hereinafter) for automatically feeding the original onto the original table 12 is disposed on the upper surface of the housing 10. The ADF 7 can open/close the original table 12, and also serves as an original holder for causing the original D set on the original table into tight contact with the original table 12.

The ADF 7 has an original tray 8, empty sensor 9, pickup roller 14, paper feed roller 15, aligning roller pair 16, size sensor 17, and conveyor belt 18. The original D is set on the original tray 8. The empty sensor 9 detects the presence/absence of an original. The pickup roller 14 picks up originals from the original tray 8 one by one. The paper feed roller 15 conveys the picked original. The aligning roller pair 16 aligns the distal end of the original. The size sensor 17 detects the size of the original D. The conveyor belt 18 is disposed to cover the original table 12 almost entirely. The plurality of originals set on the original tray 8 to face upward are sequentially picked up from the one located at the top, and each original is aligned by the aligning roller pair 16, and is conveyed by the conveyor belt 18 to a predetermined position on the original table 12.

In the ADF 7, an inverting roller 20, non-inversion sensor 21, flapper 22, and delivery roller 23 are disposed at an end on a side opposite to the aligning roller pair 16 through the conveyor belt 18.

The original D, from which image data has been read by the scanner unit 4 (to be described later), is fed out by the conveyor belt 18 from the original table 12, and is delivered onto an original delivery unit 24 on the upper surface of the ADF 7 through the inverting roller 20, flapper 21, and delivery roller 22. When the lower surface of the original D is to be read, the flapper 22 is switched. Then, the original D conveyed by the conveyor belt 18 is inverted by the inverting roller 20, and is sent by the conveyor belt 18 to the predetermined position on the original table 12 again.

The scanner unit 4 disposed in the housing 10 has an exposure lamp 25 and first mirror 26. The exposure lamp 25 serves as a light source for illuminating the original D set on the original table 12. The first mirror 26 deflects light reflected by the original D in a predetermined direction. The exposure lamp 25 and first mirror 26 are mounted on a first carriage 27 disposed below the original table 12.

The first carriage 27 is movable parallel to the original table 12, and is reciprocally moved below the original table 12 by a drive motor through a toothed belt (not shown).

A second carriage 28 movable parallel to the original table 12 is disposed below the original table 12. Second and third mirrors 30 and 31 for deflecting the light reflected by the original D and deflected by the first mirror 26 are mounted on the second carriage 28 to be perpendicular to each other. The second carriage 28 is driven by a toothed belt or the like, which drives the first carriage 27, with respect to the first carriage 27, and is moved parallel to the first carriage along the original table 12 at a speed ½ that of the first carriage.

An image forming lens 32 and a CCD sensor 34 are disposed below the original table 12. The image forming lens 32 focuses light reflected by the third mirror 31 on the second carriage 28. The CCD sensor 34 receives the reflected light focused by the image forming lens and photoelectrically converts it. The image forming lens 32 is disposed within a plane including the optical axis for light deflected by the third mirror 31, to be movable through a driving mechanism. When the image forming lens 32 moves, it forms an image of the reflected light with a desired magnification. The CCD sensor 34 photoelectrically converts incident reflected light and outputs an electrical signal corresponding to the read original D. More specifically, the CCD sensor 34 converts the light, emitted by the light source to irradiate the original and reflected by the original, into an electrical signal in units of unit pixels obtained by dividing the document image as the original horizontally and vertically, and outputs 8-bit digital data in units of pixels.

The printer unit 6 has a laser exposure unit 40 which operates as a latent image forming means. The laser exposure unit 40 has a semiconductor laser 41, polygon mirror 36, polygon motor 37, and optical system 42. The semiconductor laser 41 serves as the light source. The polygon mirror 36 serves as a scanning member for continuously deflecting a laser beam emitted from the semiconductor laser 41. The polygon motor 37 serves as a scanning motor for rotationally driving the polygon mirror 36 at a predetermined frequency (to be described later). The optical system 42 deflects the laser beam from the polygon mirror and guides it to a photosensitive drum 44 (to be described later). The laser exposure unit 40 having this arrangement is fixed to and supported by a support frame (not shown) of the housing 10.

The semiconductor laser 41 is ON/OFF-controlled in accordance with the image data of the original D read by the scanner unit 4, image data input from an external device 130, document information exchanged between facsimile machines, or the like. The laser beam from the semiconductor laser 41 is directed toward the photosensitive drum 44 through the polygon mirror 36 and optical system 42, and scans the outer surface of the photosensitive drum 44, to form an electrostatic latent image on the outer surface of the photosensitive drum 44.

The printer unit 6 has the rotatable photosensitive drum 44 serving as an image carrier disposed at almost the center of the housing 10. The outer surface of the photosensitive drum 44 is exposed by the laser beam from the laser exposure unit 40, to form a desired electrostatic latent image. An electrostatic charger 45, developing unit 46, transfer charger 48, separation pawl 49, cleaning unit 50, and discharger 51 are sequentially arranged around the photosensitive drum 44. The electrostatic charger 45 electrostatically charges the outer surface of the drum with predetermined charges. The developing unit 46 supplies toner as a developing agent to the electrostatic latent image formed on the outer surface of the photosensitive drum 44, to develop the latent image with a desired image density. The transfer charger 48 integrally has a separation charger 47 for separating a recording sheet supplied from a paper cassette (to be described later), i.e., a copy sheet P, from the photosensitive drum 44, and transfers a toner image formed on the photosensitive drum 44 onto the copy sheet P. The separation pawl 49 separates the copy sheet P from the outer surface of the photosensitive drum 44. The cleaning unit 50 cleans the toner left on the outer surface of the photosensitive drum 44. The discharger 51 electrostatically discharges the outer surface of the photosensitive drum 44. The laser exposure unit, the photosensitive drum, the electrostatic charger, the developing unit, the separation charger, the transfer charger, the cleaning unit, and the discharger make up the image forming unit of the present invention.

Upper, middle, and lower cassettes 52, 53, and 54 that can be drawn from the housing are stacked on each other in the lower portion of the housing 10, and copy sheets having different sizes are loaded in the respective cassettes. For example, A4-R size copy sheets are loaded in the upper cassette 52 as the first recording sheets, B4 size copy sheets are loaded in the middle cassette 53 as the second recording sheets, and A3 size copy sheets are loaded in the lower cassette 54 as the third recording sheets. A large-capacity feeder 55 is provided on a side of these cassettes and stores about 3000 copy sheets P with a size which is used frequently, e.g., A4 size copy sheets P. A paper feed cassette 57 serving also as a manual feed tray 56 is detachably mounted above the large-capacity feeder 55.

A convey path 58 is formed in the housing 10 to extend from the respective cassettes and the large-capacity feeder 55 through a transfer portion located between the photosensitive drum 44 and transfer charger 48. A fixing unit 60 is formed at the terminal end of the convey path 58. A delivery port 61 is formed in the side wall of the housing 10 opposing the fixing unit 60, and a delivery tray 62 is attached to the delivery port.

Pickup rollers 63 are respectively provided in the vicinities of the upper cassette 52, middle cassette 53, lower cassette 54, and paper feed cassette 57, and in the vicinity of the large-capacity feeder 55, to pickup the copy sheets P from the cassettes or large-capacity feeder one by one. The cassettes 53, 54, and 57, large-capacity feeder 55, and pickup rollers 63 form a paper feed unit. The convey path 58 is provided with a large number of paper feed roller pairs 64 which convey the copy sheet P picked up by the corresponding pickup roller 63 through the convey path 58.

In the convey path 58, a resist roller pair 65 is provided upstream of the photosensitive drum 44. The resist roller pair 65 corrects ramp of the picked copy sheet P, aligns the leading end of the toner image on the photosensitive drum 44 with the leading end of the copy sheet P, and feeds the copy sheet P to the transfer unit at the same speed as the moving speed of the outer surface of the photosensitive drum 44. A prealigning sensor 66 is provided before the resist roller pair 65, i.e., on the side of the paper feed roller pairs 64, to detect arrival of the copy sheet P and size of the copy sheet.

The copy sheets P picked up from the respective cassettes or the large-capacity feeder 55 one by one by the pickup rollers 63 are fed to the resist roller pair 65 by the paper feed roller pairs 64. The copy sheet P is fed to the transfer unit after its leading end is aligned by the resist roller pair 65.

In the transfer unit, the developer image formed on the photosensitive drum 44, i.e., the toner image, is transferred onto the copy sheet P with the transfer charger 48. The copy sheet P transferred with the toner image is separated from the outer surface of the photosensitive drum 44 by the operations of the separation charger 47 and separation pawl 49, and is conveyed to the fixing unit 60 through the conveyor belt 67 constituting part of the upper cassette 52. After the developer image is fused and fixed to the copy sheet P by the fixing unit 60, the copy sheet P is delivered onto the delivery tray 62 by a paper feed roller pair 68 and delivery roller pair 69 through the delivery port 61.

An automatic two-sided transfer unit 70 is provided below the convey path 58 to invert the copy sheet P, passing through the fixing unit 60, to the resist roller pair 65 again. The automatic two-sided transfer unit 70 has a temporary stacking portion 71, inverting path 72, pickup roller 73, and paper feed roller 75. The temporary stacking portion 71 temporarily stores the copy sheets P. The inverting path 72 branches from the convey path 58, inverts the copy sheet P passing through the fixing unit 60, and guides it to the temporary stacking portion 71. The pickup roller 73 picks up the copy sheets P stacked at the temporary stacking portion 71 one by one. The paper feed roller 75 feeds the picked sheet to the resist roller pair 65 through a convey path 74. A selector gate 76 is formed at the branching portion of the convey path 58 and inverting path 72 to selectively sort the copy sheets P to the delivery port 61 and inverting path 72.

When two-sided copying operation is to be performed, the copy sheet P passing through the fixing unit 60 is guided to the inverting path 72 by the selector gate 76, is inverted, and is temporarily stacked on the temporary stacking portion 71. The copy sheet P is then sent to the resist roller pair 65 by the pickup roller 73 and paper feed roller 75 through the convey path 74. The copy sheet P is aligned by the resist roller pair 65, and is sent to the transfer unit again. Then, a toner image is transferred to the lower surface of the copy sheet P. After that, the copy sheet P is delivered onto the delivery tray 62 through the convey path 58, fixing unit 60, and delivery roller 69.

Figure 2:
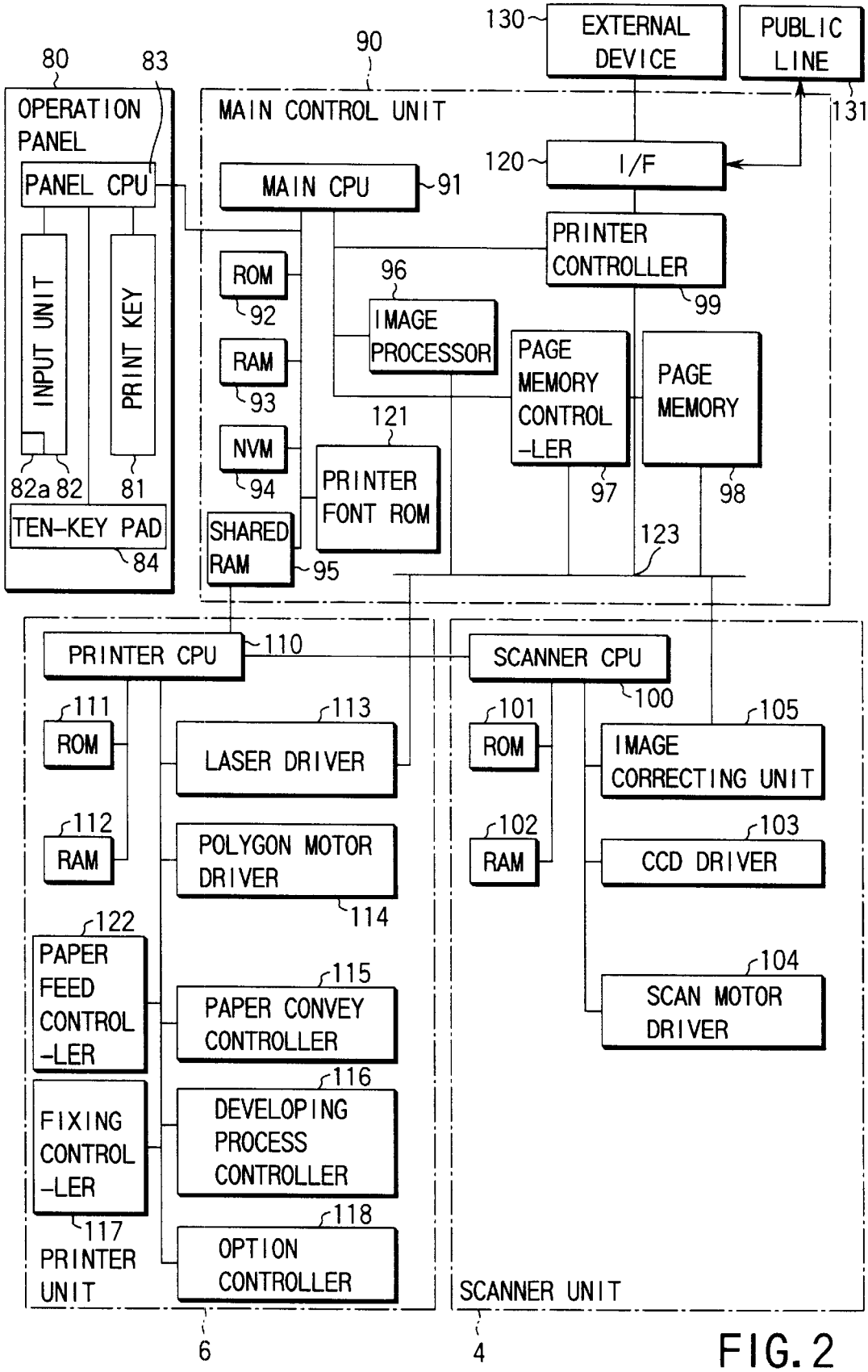

The digital copying machine also includes an operation panel 80 and main control unit 90, as shown in FIG. 2.

The operation panel 80 includes a print key 81, input unit 82, panel CPU 83, and ten-key pad 84. The print key 81 instructs copy start. The input unit 82 has a plurality of pushbutton switches or a transparent touch sensor panel which is formed on the screen of a color display tube or on a liquid crystal panel, to input conditions for image output in the digital copying machine, e.g., the copy or print count, the magnification, and the sheet-size, or to designate partial copy and to input the coordinates of the designated region. The panel CPU 83 controls the operation panel 80. The ten-key pad 84 is used to set the copy count and the copy magnification. Further-more, the input unit 82 has a facsimile key 82a needed when the copying machine is used as a facsimile.

The input unit 82 is formed in accordance with the operation procedure of the digital copying machine or the conditions to be input, and has a touch sensor serving as a plurality of input keys, and a display portion. Icons, numerals, characters, or character strings are displayed on the touch sensor. Operation guide, input content, and the like are displayed on the display portion. This display portion displays the copy count, the copy magnification, sheet-size, copy OK, the memory capacity for sorting, the readable original count corresponding to the memory capacity.

As shown in FIG. 2, the control system of a color copying machine is comprised of three CPUs, i.e., a main CPU (Central Processing Unit) 91 in the main control unit 90, a scanner CPU 100 in the scanner unit 4, and a printer CPU 110 in the printer unit 6. The main CPU 91 performs two-way communications with the printer CPU 110 through a shared RAM 95. The main CPU 91 outputs an operation instruction, and the printer CPU 110 returns a status signal. The printer CPU 110 and scanner CPU 100 perform serial communication. The printer CPU 110 outputs an operation instruction, and the scanner CPU 100 returns a status signal. The operation panel 80 is connected to the main CPU 91.

The main control unit 90 is comprised of the main CPU 91, a ROM 92, a RAM 93, an NVM 94, the shared RAM 95, an image processor 96, a page memory controller 97, a page memory 98, a printer controller 99, and a printer font ROM 151. The printer controller 99 is connected to the external device 130 such as a personal computer, and a public line 131 through an interface 120.

The main CPU 91 controls the main control unit 90 entirely. The ROM 92 stores a control program. The RAM 93 temporarily stores data.

The NVM (nonvolatile RAM) 94 is a nonvolatile memory backed up by a battery (not shown). When the power supply is turned off, data on the NVM 94 is held. The shared RAM 95 is used to perform two-way communications between the main CPU 91 and printer CPU 110.

The main CPU 91 stores image data of an original read by the scanner unit 4, image data input from the external device 130, image data input from a facsimile or the like through the public line 131, the original size, the sheet-size, the reduction (enlargement) ratio, and the like in the page memory 98. The main CPU 91 also determines the sheet-size in accordance with the original size detected by the size sensor 17 of the scanner unit 4, and stores the determination result in the page memory 98.

The page memory controller 97 stores/reads out image data in/from the page memory 98. A printer font ROM 121 stores font data corresponding to the print data.

The printer controller 99 bitmaps image data, sent from the external device 130 or public line, into image data by using font data stored in the printer font ROM 121 with a resolution corresponding to data indicating the resolution added to the image data.

The scanner unit 4 is comprised of the scanner CPU 100, and a ROM 101, RAM 102, CCD driver 103, scan motor driver 104, and image correcting unit 105. The scanner CPU 100 controls the scanner unit 4 entirely. The ROM 101 stores a control program and the like. The RAM 102 stores data. The CCD driver 103 drives the CCD sensor 34. The scan motor driver 104 controls rotations of motors which move the exposure lamp 25, the mirrors 26, 27, and 28, and the like. The image correcting unit 105 is comprised of an A/D converter, shading correction circuit, and line memory. The A/D converter converts an analog signal from the CCD sensor 34 into a digital signal. The shading correction circuit corrects variations in the threshold level, which correspond to an output signal from the CCD sensor 34 and are caused by variations in the CCD sensor 34 or by an atmospheric temperature change. The line memory temporarily stores the shading-corrected digital signal from the shading correction circuit.

The printer unit 6 is comprised of the printer CPU 110, and a ROM 111, RAM 112, laser driver 113, polygon motor driver 114, paper feed controller 123, paper convey controller 115, developing process controller 116, fixing controller 117, and option controller 118. The printer CPU 110 controls the printer unit 6 entirely. The ROM 111 stores a control program and the like. The RAM 112 stores data. The laser driver 113 turns on/off the semiconductor laser 41. The polygon motor driver 114 controls rotation of the polygon motor 37 of the laser unit 40. The paper feed controller 123 controls the operation of the paper feed unit which feeds the copy sheet P. The paper convey controller 115 controls the operation of a convey mechanism which conveys the copy sheet P. The developing process unit 116 performs charging, development, and transfer by using the electrostatic charger 45, developing unit 46, and transfer charger 48. The fixing controller 117 controls the fixing unit 60.

The image processor 96, page memory controller 97, page memory 98, printer controller 99, image correcting unit 105, and laser driver 113 are connected to each other via an image data bus 123.

The arrangement of the fixing unit 60 will be described in detail.

Figure 3:
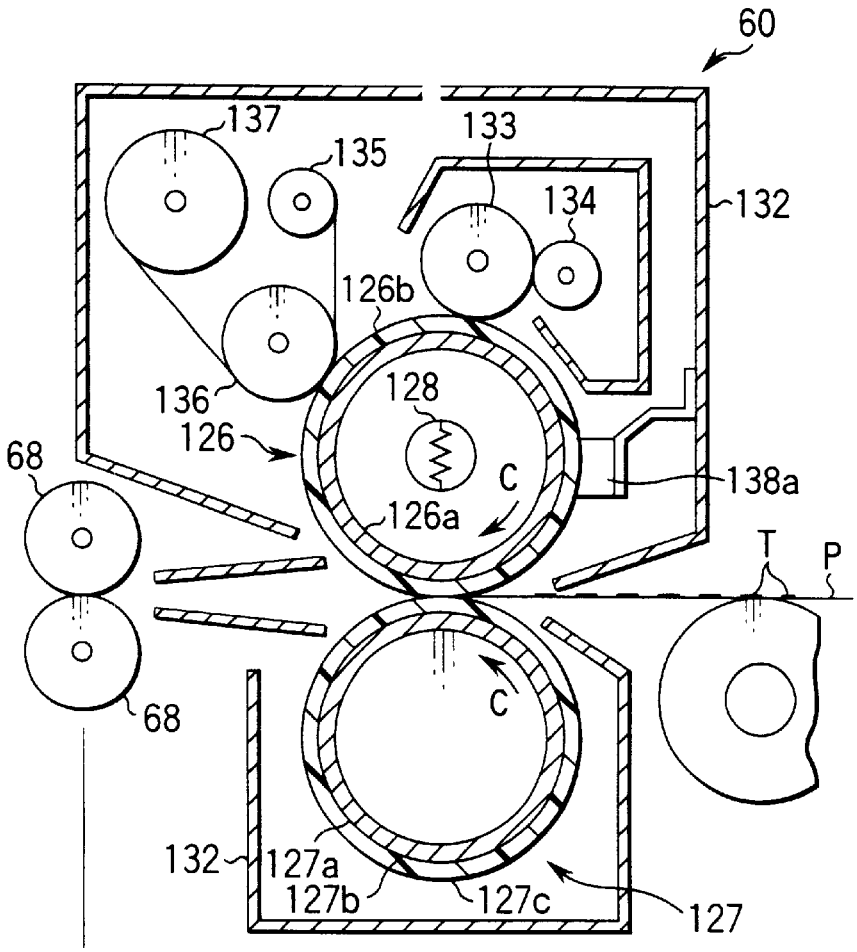
Figure 4:
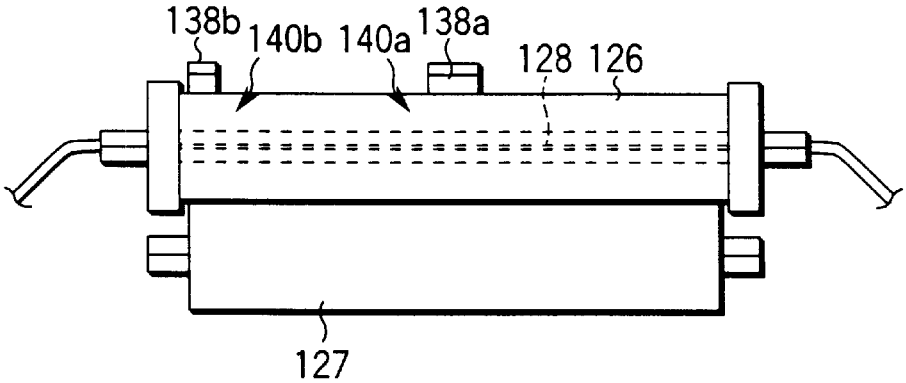

As shown in FIGS. 1, 3, and 4, the fixing unit 60 has a heating roller 126 and a press roller 127 which is in rotatable contact with the heating roller with a predetermined pressure. These rollers extend parallel to each other.

As the heating roller 126, one obtained by covering the outer surface of a 30-mm diameter, 1.5-mm thick cylindrical core bar 126*a* made of, e.g., aluminum, as a metal with a Teflon (tradename) coating layer 126*b* is used. A heater lamp 128 serving as the heating portion is disposed in the heating roller 126, and the heating roller 126 is heated by this heater lamp. As the heater lamp 128, for example, a halogen lamp having an output of 900 W is used. The two ends in the axial direction of the heating roller 126 are rotatably supported by bearings respectively.

The press roller 127 is formed by covering a 20-mm diameter stainless steel core bar 127*a* with a 5.0-mm thick elastic layer 127*b* and forming a surface layer 127*c* made of a Teflon coating layer on the elastic layer 127*b*. The axial length of the heating roller 126 is 320 mm at the portion corresponding to the Teflon coating layer 126*b*, and the axial length of the press roller 127 is 316 mm at the portion corresponding to the elastic layer 127*b*. A fixing load of about 200 N is applied to the heating roller 126 and press roller 127 with a press spring (not shown). The nip width of the heating roller 126 and press roller 127 is about 4 mm or more at the image central portion of an A4 size sheet in the longitudinal direction. These heating roller 126 and press roller 127 are covered with covers 132 except for a press-contact portion between them.

Oil applying rollers 133 and 134, and a cleaning mechanism are provided around the heating roller 126. The oil applying rollers 133 and 134 apply oil to the outer surface of the heating roller. The cleaning mechanism cleans the outer surface of the heating roller with a web. This cleaning mechanism is comprised of a web winding roller 135, pressing roller 136, and web feed roller 137. The pressing roller 136 urges the web against the outer surface of the heating roller 126.

First and second thermistors 138*a* and 138*b* are provided around the heating roller 126 to respectively serve as the first and second temperature detecting portions for detecting the surface temperature of the heating roller. The first thermistor 138*a* is set to come into contact with the outer surface of the heating roller at the central portion in the longitudinal direction of the heating roller 126, i.e., at a paper passing region 140*a* can come into contact with a copy sheet of any size that is used. The second thermistor 138*b* is set to come into contact with the outer surface of the heating roller at one end in the longitudinal direction of the heating roller 126, i.e., at a paper non-passing region 140*b* which does not come into contact with a copy sheet of any size that is used.

As each of the first and second thermistors 138*a* and 138*b*, one having a surface covered with Capton, Teflon, or the like is used.

Figure 5:
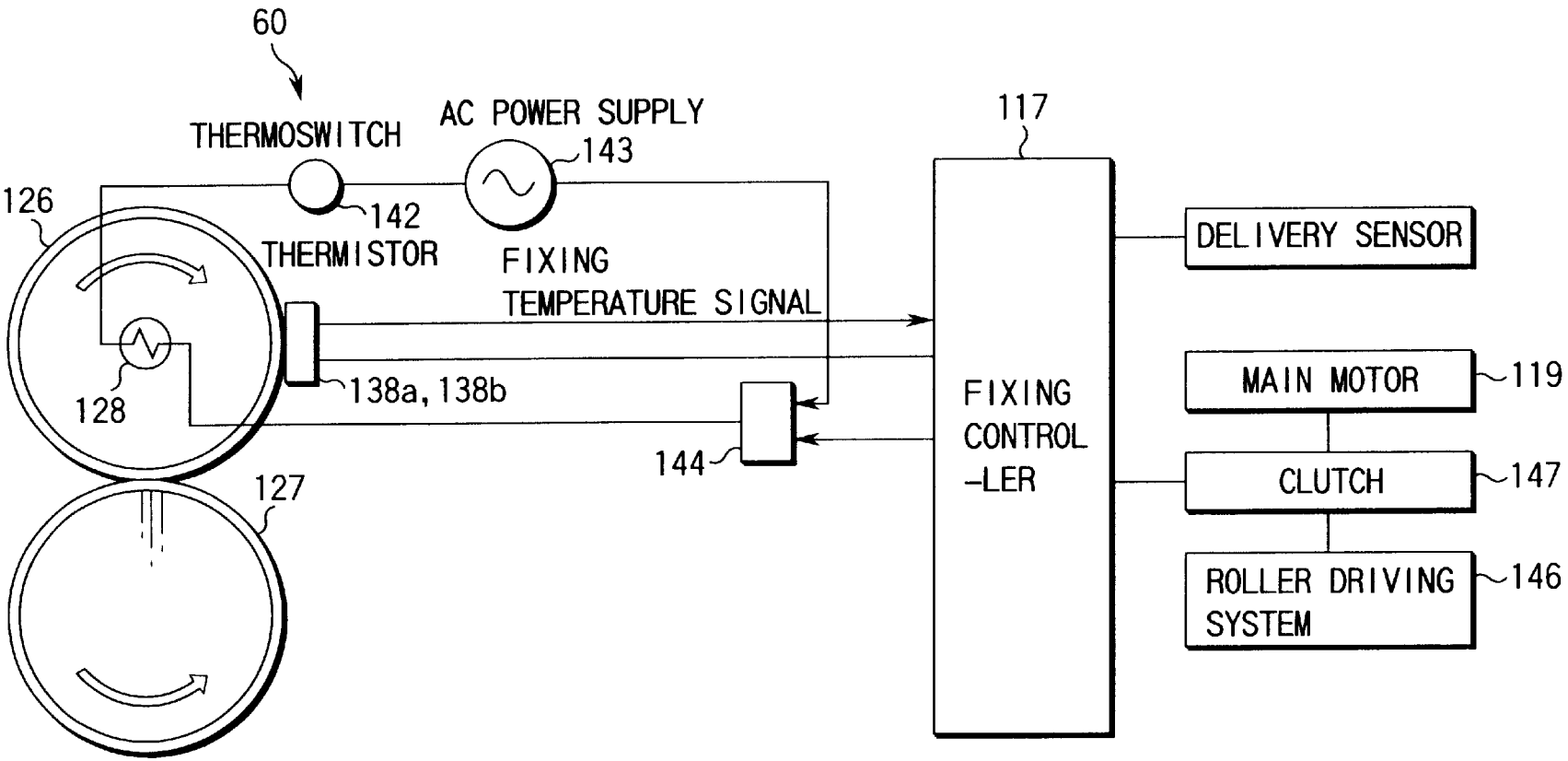

As shown in FIG. 5, the heater lamp 128 of the heating roller 126 is connected to an AC power supply 143 through a thermoswitch 142, and to the fixing controller 117 described above through a thyristor 144. The first and second thermistors 138*a* and 138*b* input detected temperature signals to the fixing controller 117. The fixing controller 177 turns on/off the heater lamp 128 in accordance with the first detection temperature of the first thermistor 138*a*, thereby controlling the temperature of the heating roller 126.

The RAM 112 of the printer unit 2 stores the reference fixing temperature, a fixing permit temperature range (to be described later), and the like of the heating roller 126 as data necessary for controlling the fixing unit 60.

A roller driving system 146 serving as a driving unit for rotationally driving the heating roller 126 and press roller 127 is connected to a main motor 119 of the printer unit 6 through an electromagnetic clutch 147. The fixing controller 117 turns on/off the electromagnetic clutch 147, thereby controlling rotation of the heating roller 126 and press roller 127.

With the fixing unit 80 having the above arrangement, during image forming operation, the heating roller 126 is maintained at a predetermined reference fixing temperature, e.g., 180°, by turning on/off the heater lamp 128, and is rotated in a direction indicated by an arrow C in FIG. 3 at a predetermined peripheral velocity.

When a copy sheet P on which a toner image T has been formed by the image forming unit is fed to the fixing unit 60 by a conveyor belt 67, this copy sheet P is guided to a portion between the heating roller 126 and press roller 127, and is conveyed by these rollers toward the paper feed roller pair 68. When the copy sheet P passes between the heating roller 126 and press roller 127, the toner image T on the copy sheet P is heated and fused by the heating roller, and is urged against the copy sheet P by the pressure of the press roller. Thus, the toner image T is fused and fixed on the copy sheet P. The copy sheet P on which the toner image T is fixed is delivered onto the delivery tray 62 by the paper feed roller pair 68.

Figure 6:
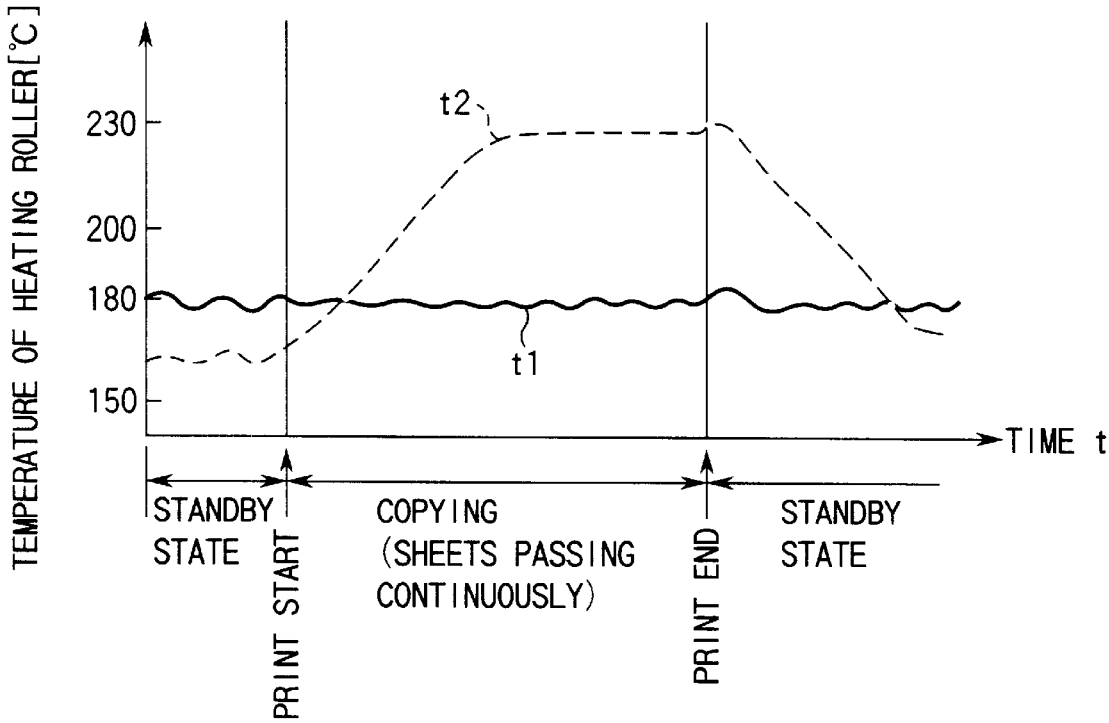
Figure 7:
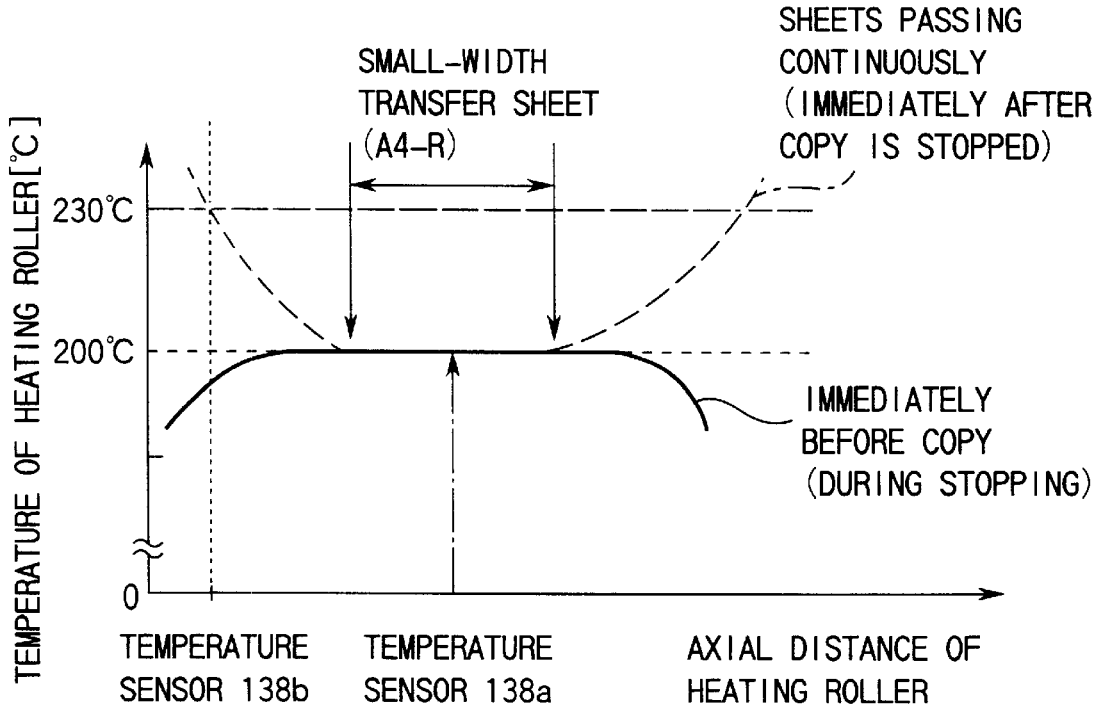

If the width of the copy sheet is set to the length of a sheet in the axial direction of the heating roller 126, when print operation is performed by using a small-width sheet such as an A4-R sheet, the sheet width of the A4-R sheet is sufficiently smaller than the axial direction of the heating roller. Hence, a paper passing region where the A4-R sheet passes, i.e., the central portion of the heating roller, and a paper non-passing region which is located on the two sides of the paper passing region and where the A4-R sheet does not pass, i., which does not come into contact with the sheet, are present at the press contact portion between the heating roller 126 and press roller 127. Accordingly, when continuous print operation is performed by using a plurality of small-width sheets, as shown in FIGS. 6 and 7, a surface temperature t1 of the paper passing region of the heating roller 126, which is detected by the first thermistor 138*a*, is maintained almost at a reference fixing temperature of 180° C., while a surface temperature t2 of the paper non-passing region, which is detected by the second thermistor 138*b*, increases to about 230° C. While the surface temperature of the paper non-passing region has increased excessively in this manner, if fixing operation is performed on a large-width copy sheet, e.g., a B4 sheet, a fixing defect occurs on two sides of the B4 sheet. After the continuous print operation is ended, when the copying machine is set in the standby state, the temperature of the paper non-passing region of the heating roller 126 decreases to be slightly lower than the reference fixing temperature within about 30 seconds.

Figure 8:
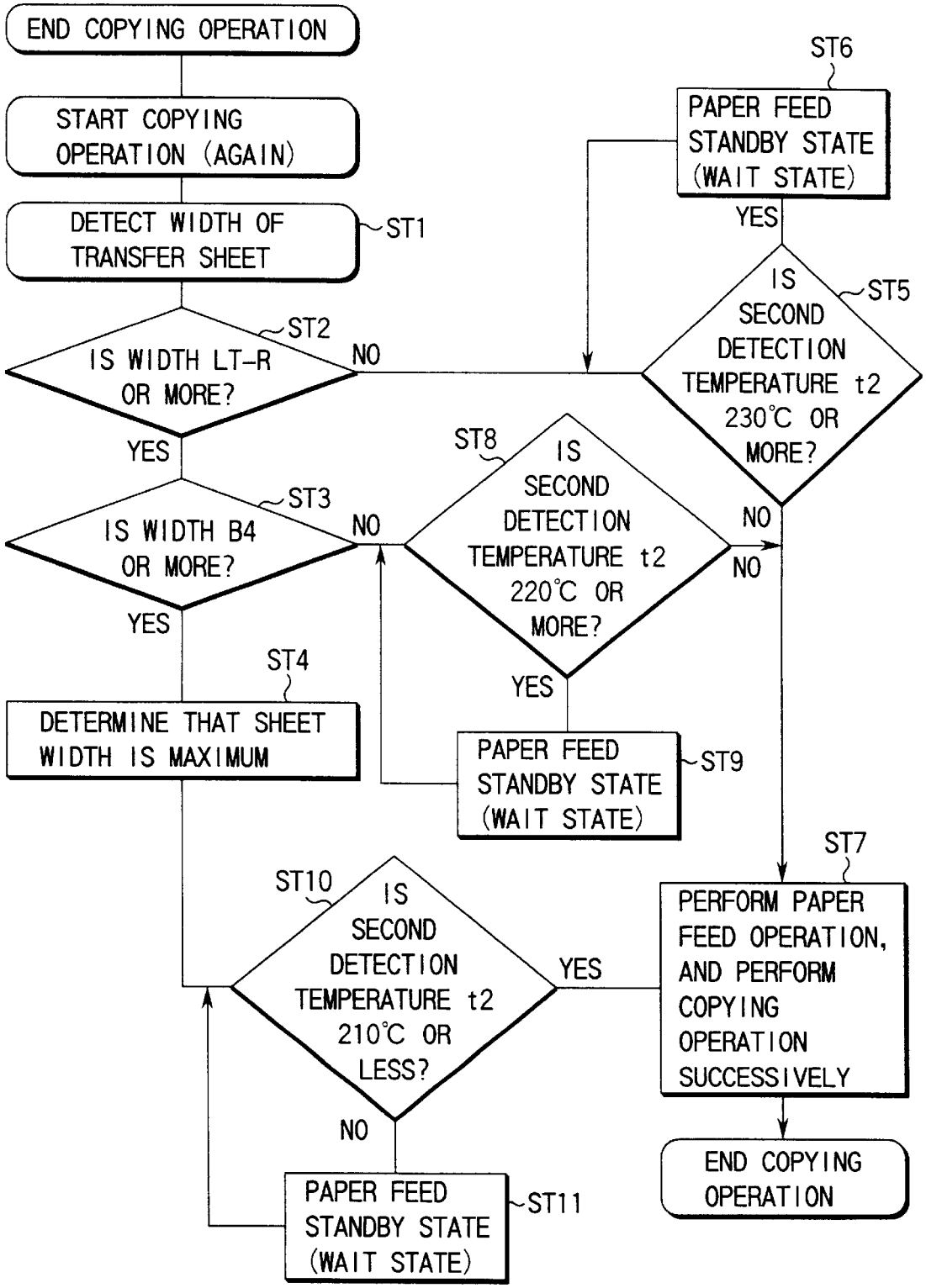

In the digital copying machine according to this embodiment, when copying operation is performed as a copying machine, the fixing unit 60 operates on the basis of the control operation shown in FIG. 8 and the condition shown in FIG. 9.

More specifically, after the previous copying operation is ended, when the next copying operation is to be performed, the fixing controller 117 detects the size of a copy sheet to be used in this next copying operation (ST1). This size detection is performed on the basis of the sheet-size selected by the input unit 82 of the operation panel 80, and a detection signal from the size sensor 17 of the ADF 7 or the prealigning sensor 66 of the printer unit 6.

Whether the next copy sheet has a size of LT-R or more (ST2), and whether this copy sheet has a size exceeding LT-R and equal to B4 or less (ST3) are checked. If the size is B4 or more, it is determined that this sheet is the maximum-size copy sheet loaded in the copying machine (ST4).

If the next copy sheet has a size smaller than LT-R, the fixing controller 117 checks whether the surface temperature of the paper non-passing region of the heating roller 126, which is detected by the second thermistor 138*b*, i.e., the second detection temperature t2, is 230° C. or more (ST5). If the second detection temperature t2 is 230° C. (first detection temperature t1+50° C.) or more, the sheet convey operation and the image forming operation of the printer unit 6 are stopped, and the copying machine is set in the standby state (ST6). Then, the fixing controller 117 starts sheet convey operation and image forming operation when the second detection temperature t2 becomes lower than 230° C., and successively performs copying operation on the next copy sheet (ST7).

In ST3, if it is detected that the next copy sheet has a size larger than LT-R and smaller than B4, the fixing controller 117 detects whether the second detection temperature t2 detected by the second thermistor 138*b* is 220° C. (first detection temperature t1+40° C.) or more (ST8). If the second detection temperature t2 is 220° C. or more, the sheet convey operation and the image forming operation of the printer unit 6 are stopped, and the copying machine is set in the standby state (ST9). Then, the fixing controller 117 starts sheet convey operation and image forming operation when the second detection temperature t2 becomes lower than 220° C., and successively performs copying operation on the next copy sheet (ST7).

If it is determined in ST4 that the next copy sheet has size larger than B4, the fixing controller 117 checks whether the second detection temperature t2 detected by the second thermistor 138*b* is 210° C. (first detection temperature t1+30° C.) Dr more (ST10). If the second detection temperature t2 is 210° C. or more, the sheet convey operation and the image forming operation of the printer unit 6 are stopped, and the copying machine is set in the standby state (ST11). Then, the fixing controller 117 starts sheet convey operation and image forming operation when the second detection temperature t2 becomes lower than 210° C., and successively performs copying operation on the next copy sheet (ST7).

For example, as shown in FIGS. 10A and 10B, when continuous copying operation is performed by using A4-R size copy sheets smaller than LT-R size copy sheets, the second detection temperature t2 of the heating roller 126 increases to about 230° C. Hence, when starting the next copying operation, if it is detected that the copy sheet to be used in the next copying operation is an A3 size copy sheet, the fixing controller 117 stops the paper feed motor and the image forming operation to set the copying machine in the standby state. The fixing controller 117 starts paper feed operation and image forming operation when the second detection temperature t2 decreases to 210° C., and performs the next copying operation using an A3 size copy sheet.

Figure 11A:
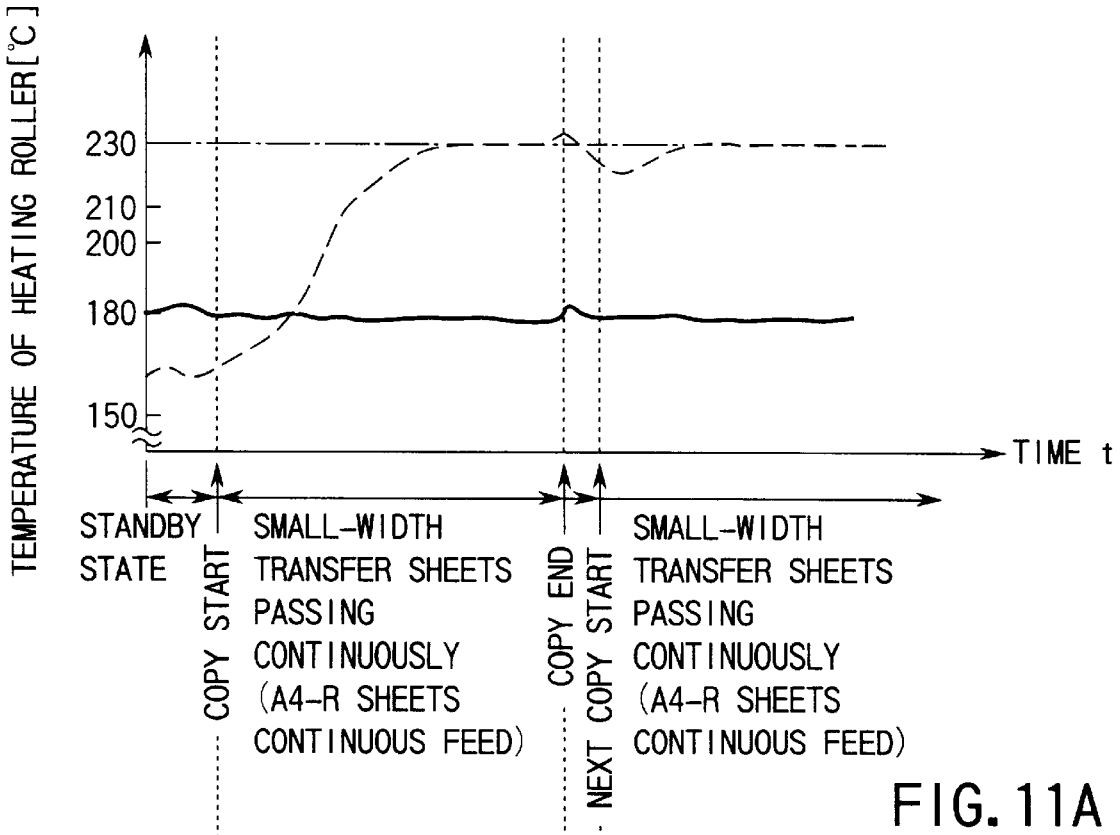
FIG. 11A is a graph showing another example of the temperature change in the heating roller in the copying operation.
Figure 11B:
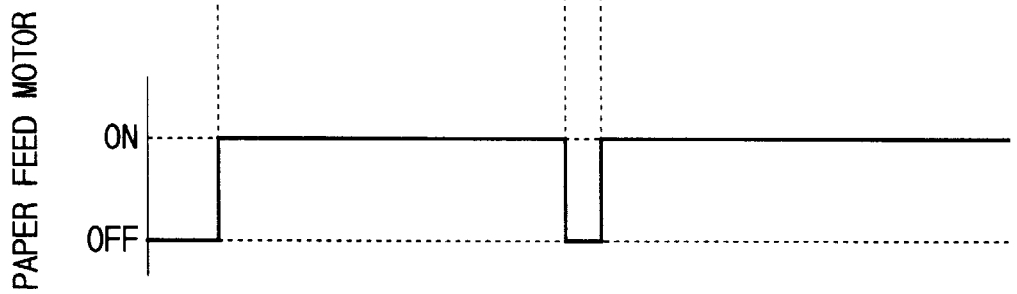
FIG. 11B is a timing chart showing the ON/OFF states of the paper feed motor during the copying operation.

As shown in FIGS. 11A and 11B, after continuous copying operation is performed by using A4-R size copy sheets smaller than LT-R size copy sheets, when the next copying operation is to be started, if it is detected that the copy sheet to be used in the next copying operation is an A4-R size copy sheet, the fixing controller 117 checks whether the second detection temperature t2 is 230° C. or more. In this case, the second detection temperature t2 decreases to 230° C. or less after the previous copying operation is ended and before the next copying operation is started. Hence, the fixing controller 117 starts the next copying operation imsheetstely without setting the copying machine in the copy standby state.

As described above, according to this digital copying machine, in copying operation, upon continuous image forming operation performed on a plurality of small-size copy sheets, when the temperature at the end of the heating roller 126 increases to be higher than usual, the image forming operation of the image forming unit and the convey operation of the convey mechanism are controlled in accordance with the size of a copy sheet to be fed next and the temperature of the heating roller. More specifically, when image formation is to be successively performed on a small-size copy sheet, the image forming operation of the image forming unit and the convey operation of the convey mechanism are continued to shorten the standby time. Inversely, when image formation is to be performed on a larger-size copy sheet, the image forming operation of the image forming unit and the convey operation of the convey mechanism are set in the standby state until the temperature of the paper non-passing region of the heating roller 126 decreases to a predetermined temperature. As a result, fixing can be performed within a temperature region where a fixing defect and an image defect do not occur, so that a stable image can be obtained, and the standby time of the image forming operation is shortened, thereby improving the efficiency.

Figure 12:
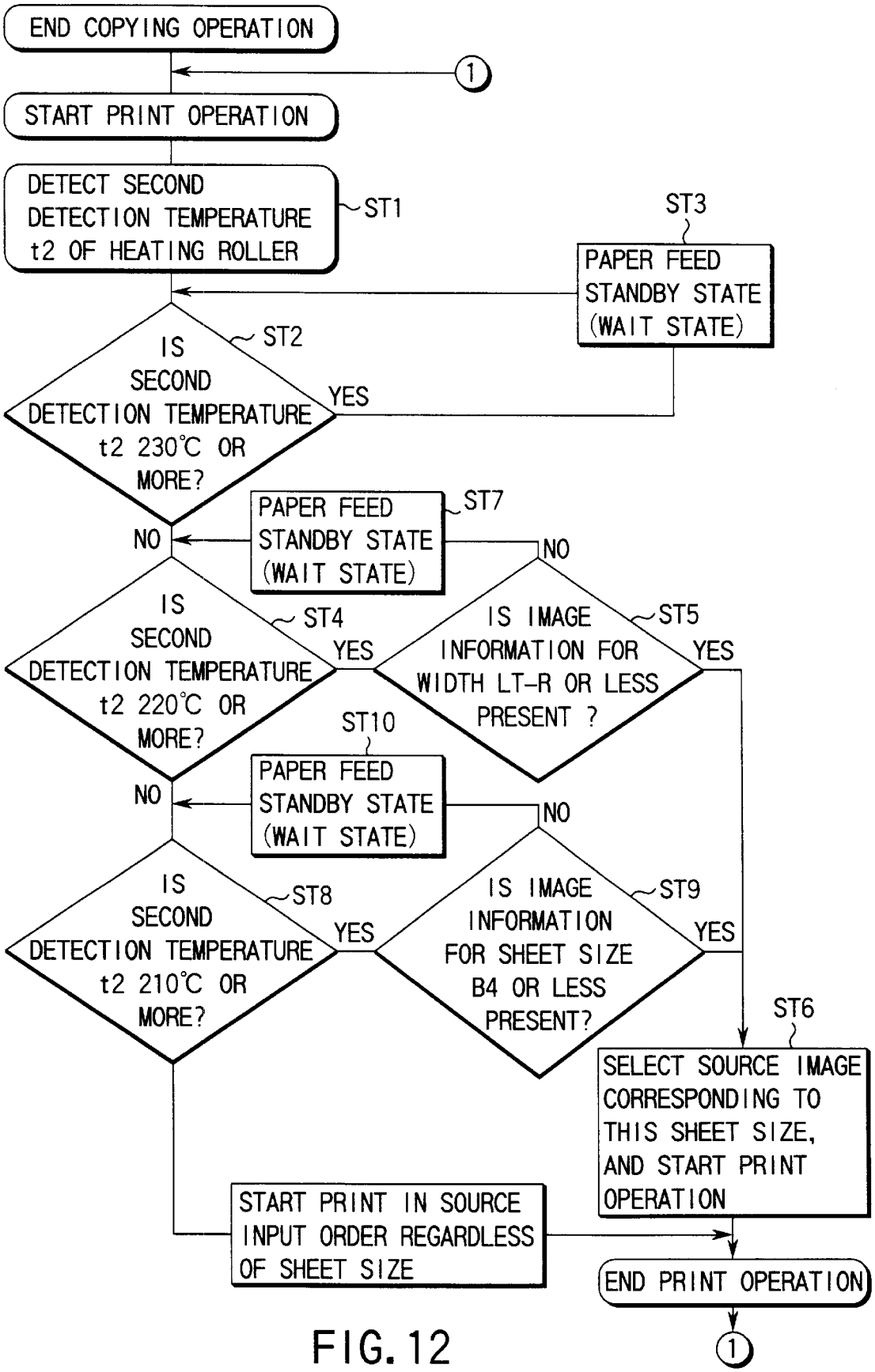
Figures 13, 14:
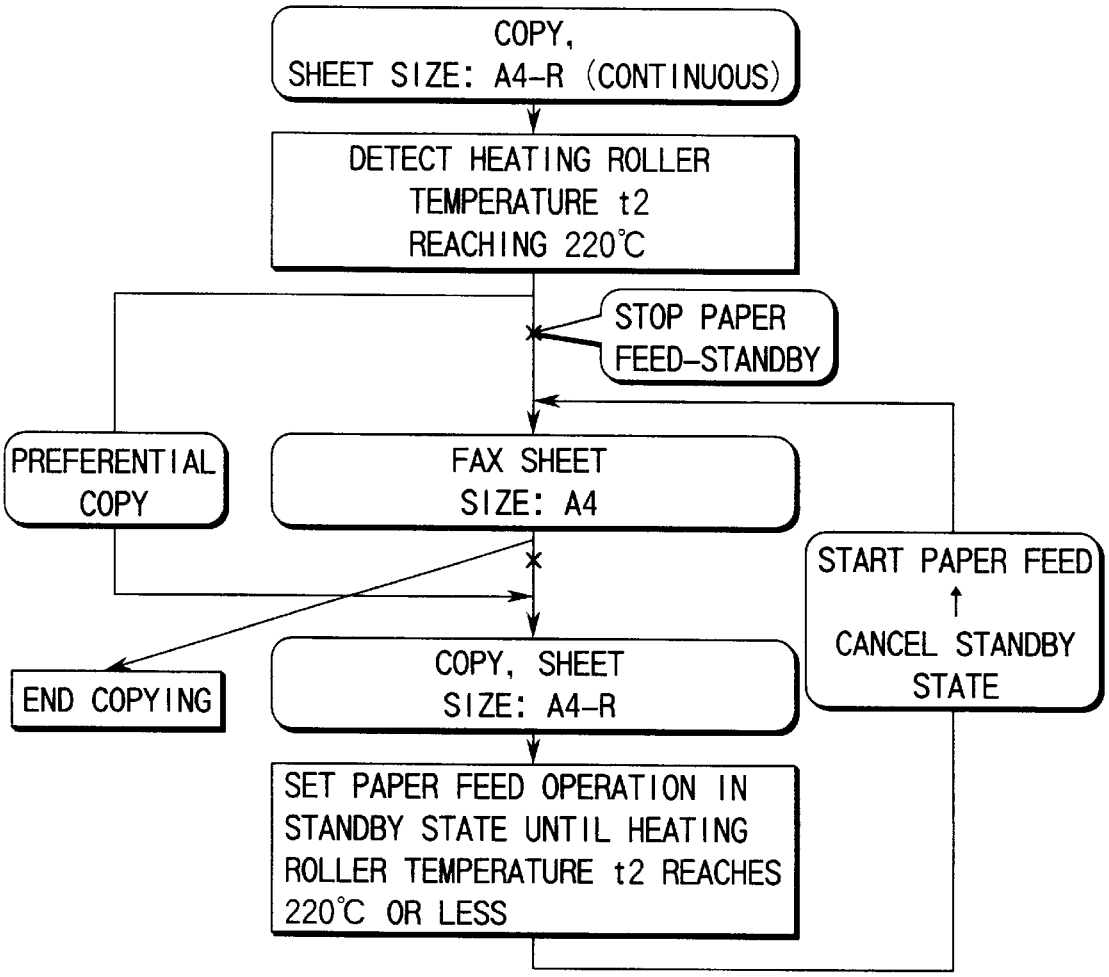

In the digital copying machine described above, when copying operation, print operation of image data input from the external device 130, and print operation of facsimile image data input through the public line 131 are to be performed in the composite manner, the fixing unit 60 operates on the basis of the control operation shown in FIG. 12 and the condition shown in FIG. 13.

After the previous copying operation is ended, when the next image forming operation is to be started, the fixing controller 117 detects the surface temperature of the paper non-passing region 140*b* of the heating roller 126 which is detected by the second thermistor 138*b*, i.e., the second detection temperature t2 (ST1). The fixing controller 117 checks whether the second detection temperature t2 is 230° C. (first detection temperature t1+50° C.) or more (ST2). If the second detection temperature t2 is 230° C. or more, the sheet convey operation and the image forming operation of the printer unit 6 are stopped, and the copying machine is set in the standby state (ST3). Then, the flow returns to step 2.

If it is determined that the second detection temperature t2 is less than 230° C., the fixing controller 117 checks whether the second detection temperature t2 is 220° C. (first detection temperature t1+40° C.) or more (ST4). If the second detection temperature t2 is 220° C. or more, it is checked whether image data corresponding to a copy sheet with a size LT-R or smaller than that is present among the image data stored in the page memory 98 of the main control unit 90 (ST5). If image data corresponding to a copy sheet with a size LT-R or smaller than that is present, the fixing controller 117 selectively reads out this image data, and starts the image forming operation and sheet convey operation of the print unit 6 (ST6).

In step 5, if image data corresponding to a copy sheet with a size LT-R or smaller than that is not present, the fixing controller 117 stops the image forming operation and sheet convey operation of the printer unit 6, and the copying machine is set in the standby state (ST7). Then, the flow returns to step 4.

In step 4, if it is determined that the second detection temperature t2 is less than 220° C., the fixing controller 117 checks whether the second detection temperature t2 is 210° C. (first detection temperature t1+30° C.) or more (ST8). If the second detection temperature t2 is 210° C. or more, it is checked whether image data corresponding to a copy sheet with a size B4 or smaller than that is present among the image data stored in the page memory 98 of the main control unit 90 (ST9). If image data corresponding to a copy sheet with a size B4 or smaller than that is present, the fixing controller 117 selectively reads out this image data, and starts the image forming operation and sheet convey operation of the print unit 6 (ST6).

In step 9, if image data corresponding to a copy sheet with a size B4 or smaller than that is not present, the fixing controller 117 stops the image forming operation and sheet convey operation of the printer unit 6, and the copying machine is set in the standby state (ST10). Then, the flow returns to step 8.

In step 8, if it is determined that the second detection temperature t2 is less than 210° C., the fixing controller 117 reads out the image data from the page memory 98 of the main control unit 90 in the input order regardless of the corresponding sheet-size, and starts the image forming operation and sheet convey operation of the print unit 6 (ST11).

For example, as shown in FIGS. 14 and 15, while continuous copying operation is performed by using A4-R size copy sheets, assume that facsimile image data input through the public line 131 and corresponding to sheet-size A4, and image data read by the scanner unit 4 of the copying machine and corresponding to sheetsize A4-R are sequentially input to the page memory 98 of the main control unit 90. In this case, after copying operation using A4-R size copy sheets is ended, the fixing controller 117 detects the second detection temperature t2 of the heating roller 126. If it is determined that the second detection temperature t2 is 220° C., the fixing controller 117 selectively reads, among the image data stored in the page memory 98, image data corresponding to sheet-size A4-R, and starts image forming operation prior to the facsimile image data corresponding to sheet-size A4.

After print operation of the image data corresponding to A4-R is ended, the fixing controller 117 detects the second detection temperature t2 of the heating roller 126. If the second detection temperature t2 is 220° C. or more, the image forming operation and paper feed operation are set in the standby state. When the second detection temperature t2 becomes less than 220° C., the fixing controller 117 reads out facsimile image data corresponding to sheet-size A4 left in the page memory 98, and starts image forming operation.

According to the digital copying machine having the above arrangement, image data corresponding to the copy sheet with a size appropriate for the second detection temperature at the end of the heating roller 126, which is detected by the second thermistor 138*b*, is selected from the page memory 98, and image forming operation of this image data is preferentially performed. Therefore, for example, upon continuous image formation on a plurality of small-size copy sheets, when the temperature at the end of the heating roller 126 becomes higher than a normal temperature, if image data corresponding to a similarly small-size copy sheet is present, this image data is selected, and image forming operation is continued.

If image data corresponding to a copy sheet with a size appropriate for the temperature at the end of the heating roller 126 is not present, the image forming operation of the image forming unit and the convey operation of the convey mechanism are set in the standby state until the temperature of the heating roller decreases to a predetermined temperature. After the second detection temperature decreases to the predetermined temperature, the next print operation is started. Furthermore, if the second detection temperature of the heating roller 126 is lower than the predetermined value, pieces of image data stored in the page memory 98 are sequentially subjected to image data in the input order regardless of the copy sheet-size.

As a result, an image defect and a fixing defect can be prevented, and the standby time of the image forming operation is shortened, so that the efficiency can be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, an image forming apparatus according to the present invention is not limited to the digital copying machine described above, and the present invention can also be applied to other image forming apparatuses such as an analog copying machine, a laser printer, and the like. The reference fixing temperature of the heating roller is not limited to 180° C., but various temperatures can be selected in accordance with the types of the sheet and developer to be used. Simultaneously, the size of the copy sheet to be used can be changed if necessary, and various allowable fixing temperatures can be set to correspond to the different sheet-sizes.

What is claimed is:

1. An image forming apparatus comprising:

image forming means for forming a developer image on a recording medium;

fixing means for heating and pressing the developer image formed by the image forming means to fix the developer image on the recording medium;

a paper feed section for selectively feeding various types of recording media having different sizes;

convey means for conveying the recording medium fed from the paper feed section through the image forming means and the fixing means;

a size detector for detecting a size of the recording medium fed from the paper feed section;

a temperature detector for detecting a surface temperature of the fixing means; and control means for controlling a fixing temperature of the fixing means in accordance with a predetermined reference temperature, and controlling image forming operation of the image forming means and recording medium convey operation of the convey means in accordance with a size of a recording medium to be fed next and the surface temperature of the fixing means which is detected by the temperature detector;

wherein the control means includes means for stopping the image forming operation of the image forming means and the recording medium convey operation of the convey means so as to set a standby state, when the size of a recording medium to be fed next is larger than a predetermined size according to the surface temperature of the fixing means which is detected by the temperature detector, and for starting the image forming operation of the image forming means and the recording medium convey operation of the convey means when the detected surface temperature decreases to a temperature according to the size of the next recording medium.

2. An image forming apparatus according to claim 1, wherein the control means includes means for successively performing the image forming operation of the image forming means and the recording medium convey operation of the convey means when the size of the next recording medium is equal to or smaller than a predetermined size according to the surface temperature of the fixing means which is detected by the temperature detector.

3. An image forming apparatus according to claim 1, wherein the fixing means comprises:

a heating roller having a heating portion therein, and a press roller provided in rolling contact with the heating roller and cooperating with the heating roller to heat and press the recording medium passing between the heating roller and the press roller; and wherein the temperature detector detects a surface temperature of the heating roller.

4. A method of forming an image on a recording medium comprising the steps of:

selectively supplying a recording medium with a size corresponding to an image to be formed;

forming a developer image on the supplied recording medium; and heating and pressing the developer image formed on the recording medium by fixing means, thereby fixing the developer image on the recording medium;

the step of fixing the developer image including:

detecting a surface temperature of the fixing means;

controlling a fixing temperature of the fixing means in accordance with a predetermined reference temperature, and controlling image forming operation of the developer image and recording medium supplying operation in accordance with a size of a recording medium to be supplied next and the detected surface temperature of the fixing means;

stopping the image forming operation and the recording medium supplying operation so as to set a standby state, when the size of a recording medium to be supplied next is larger than a predetermined size according to the detected surface temperature of the fixing means; and starting the image forming operation of a developer image and the recording medium supplying operation when the detected surface temperature decreases to a temperature according to the size of the next recording medium.

5. A method according to claim 4, wherein the step of fixing the developer image including:

successively performing the image forming operation and the recording medium supplying operation when the size of the next recording medium is equal to or smaller than a predetermined size according to the detected surface temperature of the fixing means.

6. A method according to claim 4, which further comprises the steps of: storing image data read from a document and various types of image data input from outside in a memory; and selecting image data to be subjected to image formation next from image data stored in the memory, in accordance with the detected surface temperature of the fixing means.

7. An image forming apparatus comprising:

image forming means for forming a developer image on a recording medium;

fixing means for heating and pressing the developer image formed by the image forming means to fix the developer image on the recording medium, the fixing means including a heating roller having a heating portion therein, and a press roller provided in rolling contact with the heating roller and cooperating with the heating roller to heat and press the recording medium passing between the heating roller and the press roller;

a paper feed section for selectively feeding various types of recording media having different sizes;

convey means for conveying the recording medium fed from the paper feed section through the image forming means and the fixing means;

a size detector for detecting a size of the recording medium fed from the paper feed section;

a temperature detector for detecting a surface temperature of the heating roller; and control means for controlling a fixing temperature of the fixing means in accordance with a predetermined reference temperature, and controlling image forming operation of the image forming means and recording medium convey operation of the convey means in accordance with a size of a recording medium to be fed next and the surface temperature of the fixing means which is detected by the temperature detector;

wherein the heating roller includes a paper passing region which comes into contact with a recording medium of any size, and a paper non-passing region which does not come into contact with a recording medium of any size, the temperature detector includes a first temperature detector for detecting a surface temperature of the paper passing region of the heating roller, and a second temperature detector for detecting a surface temperature of the paper non-passing region of the heating roller, and the control means has a fixing control unit for controlling the heating portion such that a first temperature detected by the first temperature detector becomes a predetermined reference temperature, and controlling the image forming operation of the image forming means and the recording medium convey operation of the convey means in accordance with a size of a recording medium to be fed next and a second temperature detected by the second temperature detector.

8. An image forming apparatus according to claim 7, wherein the paper feed section contains first recording medium, second recording medium having a size larger than that of the first recording medium, and third recording medium having a size larger than that of the second recording medium, and the fixing control means sets the image forming operation of the image forming means and the convey operation of the convey means in a standby state until t1 and t2 satisfy:

$t2<t1+500°$ C. when the recording medium to be fed next is the first recording medium, $t2<t1+40°$ C. when the recording medium to be fed next is the second recording medium, and $t2<t1+30°$ C. when the recording medium to be fed next is the third recording medium where t1 is the first temperature detected by the first temperature detector, and t2 is the second temperature detected by the second temperature detector.

9. An image forming apparatus according to claim 8, wherein the fixing control means sets the image forming operation of the image forming means and the convey operation of the convey means in a standby state until t2 satisfies:

$t2<230°$ C. when the recording medium to be fed next is the first recording medium, $t2<220°$ C. when the recording medium to be fed next the second recording medium, and $t2<210°$ C. when the recording medium to be fed next is the third recording medium.

10. An image forming apparatus comprising:

image forming means for forming a developer image on a recording medium;

fixing means for heating and pressing the developer image formed by the image forming means to fix the developer image on the recording medium;

a paper feed section for selectively feeding various types of recording media having different sizes;

convey means for conveying the recording medium fed from the paper feed section through the image forming means and the fixing means;

a size detector for detecting a size of the recording medium fed from the paper feed section;

a temperature detector for detecting a surface temperature of the fixing means;

an original table where an original is to be set;

an image reading unit for reading image data of the original set on the original table; and a storage portion for the image data read by the image reading unit and various types of image data input from outside; and control means for controlling a fixing temperature of the fixing means in accordance with a predetermined reference temperature, and controlling image forming operation of the image forming means and recording medium convey operation of the convey means in accordance with a size of a recording medium to be fed next and the surface temperature of the fixing means which is detected by the temperature detector;

wherein the control means includes fixing control means for selecting image data to be subjected to image formation next from the storage portion in accordance with the surface temperature of the fixing means which is detected by the temperature detector.

11. An image forming apparatus according to claim 10, wherein the fixing control means includes means for preferentially selecting image data to be subjected to image formation next, which corresponds to a recording medium with a predetermined size appropriate for the surface temperature of the fixing means which is detected by the temperature detector, from the storage portion and performing the image forming operation by the image forming means, when various image data are stored in the storage portion.

12. An image forming apparatus according to claim 11, wherein the fixing control means includes means for stopping the image forming operation of the image forming means and the recording medium convey operation of the convey means so as to set a standby state, when image data, corresponding to a recording medium with a predetermined size appropriate for the surface temperature of the fixing means which is detected by the temperature detector, is not present in the storage portion, and for starting the image forming operation of the image forming means and the recording medium convey operation of the convey means when the detected surface temperature decreases to a predetermined temperature.

13. An image forming apparatus according to claim 11, wherein the fixing control means includes means for reading out image data from the storage portion in the input order and successively performing the image forming operation of the image forming means and the recording medium convey operation of the convey means when the surface temperature of the fixing means detected by the temperature detector is lower than a predetermined temperature.

14. An image forming apparatus according to claim 10, wherein the fixing means comprises a heating roller having a heating portion therein, and a press roller provided in rolling contact with the heating roller and cooperating with the heating roller to heat and press the recording medium passing between the heating roller and the press roller, the heating roller including a paper passing region which comes into contact with a recording medium of any size, and a paper non-passing region which does not come into contact with a recording medium of any size;

the paper feed section contains first recording medium, second recording medium having a size larger than that of the first recording medium, and third recording medium having a size larger than that of the second recording medium;

the temperature detector includes a first temperature detector for detecting a surface temperature of the paper passing region of the heating roller, and a second temperature detector for detecting a surface temperature of the paper non-passing region of the heating roller; and the fixing control means controls the heating portion such that a first temperature detected by the first temperature detector becomes a predetermined reference temperature, and selects image data to be subjected to image formation from the storage portion in accordance with the second temperature detected by the second temperature detector.

15. An image forming apparatus according to claim 14, wherein the fixing control means sets, when $t2 \geqq t1+50°$ C., image forming operation of the image forming means and convey operation of the convey means in a standby state regardless of a size of a recording medium to be fed next, when $t2 \geqq t1+40°$ C., selects image data having a size corresponding to the first recording medium, and starts the image forming operation of the image forming means and the convey operation of the convey means, when $t2 \geqq t1+30°$ C., selects image data having a size corresponding to the second recording medium, and starts the image forming operation of the image forming means and the convey operation of the convey means, and when $t2<t1+30°$ C., selects image data from the storage portion in accordance with an input order, and starts the image forming operation of the image forming means and the convey operation of the convey means, where t1 is the first temperature detected by the first temperature detector, and t2 is the second temperature detected by the second temperature detector.

16. An image forming apparatus according to claim 15, wherein the fixing control unit sets, when $t2 \geqq 230°$ C., image forming operation of the image forming means and convey operation of the convey means in a standby state regardless of a size of a recording medium to be fed next, when $t2 \geqq 220°$ C., selects image data having a size corresponding to the first recording medium, and starts the image forming operation of the image forming means and the convey operation of the convey means, when $t2 \geqq 210°$ C., selects image data having a size corresponding to the second recording medium, and starts the image forming operation of the image forming means and the convey operation of the convey means, and when $t2<210°$ C., selects image data in accordance with an input order, and starts the image forming operation of the image forming means and the convey operation of the convey means.

17. An image forming apparatus according to claim 10, which further comprises a main control unit connected to a public line to input facsimile image data, input through the public line, to the storage portion, and connected to an external device to input image data, input from the external device, to the storage portion.

* * * * *